US005078051A

United States Patent [19]

Amundson

[11] Patent Number: 5,078,051

[45] Date of Patent: Jan. 7, 1992

[54] AMMUNITION DATA TRANSMISSION SYSTEM

[75] Inventor: Mark D. Amundson, Cambridge, Minn.

[73] Assignee: Alliant Techsystems Inc., Minnetonka, Minn.

[21] Appl. No.: 655,071

[22] Filed: Feb. 14, 1991

[51] Int. Cl.[5] ..... F42C 17/04

[52] U.S. Cl. ..... 102/206; 89/6

[58] Field of Search ..... 102/206, 200; 89/6, 89/6.5

[56] References Cited

U.S. PATENT DOCUMENTS 2,415,362 2/1947 Midgley ..... 89/6

3,814,017 6/1974 Backstein et al. ..... 102/206

*Primary Examiner*—Charles Jordan

*Attorney, Agent, or Firm*—Haugen and Nikolai

[57] ABSTRACT

An improved ammunition data transmission system includes alternately applied parallel sources of high frequency of alternating current (AC) voltage and direct current (DC) voltage. The high frequency AC voltage is applied first to provide updated data and to activate the electronic control package for the round in the projectile. the DC voltage then activates the electric primer system for igniting the propellant charge to fire the round. Both the electronics control package and the electric primer system are connected in parallel with the source of AC voltage and, in the preferred embodiment, the parallel connected circuitry contains a capacitor to prevent DC voltage from reaching the electronics control package and an inductor for preventing AC voltage from reaching the electric primer system.

5 Claims, 2 Drawing Sheets

AMMUNITION DATA TRANSMISSION SYSTEM

BACKGROUND OF THE INVENTION

I. Field of the Invention

The present invention is directed generally to the field of sophisticated or "smart" large caliber projectile ammunition and, more particularly, to an improved electrical communication system which facilitates the transmission of pre-launch communication from the firing mission computer to update the program of the round.

II. Description of the Related Art

The evolution of large caliber ordnance generally has led to the development of increasingly sophisticated projectiles and firing systems. Rather than just being aimed at a potential target and fired for a pre-selected distance or upon impact, many current rounds contain highly sensitive target proximity detection devices which operate precision arming and detonating circuits. This allows, for example, a projectile warhead to be detonated at its closest proximity to a target of interest. In addition to electronic control and sensing improvements, the construction of the rounds themselves has produced vastly improved capabilities in terms of the lethality produced by a single round on a target.

Conventional large caliber ammunition of the class described, such as that fired by military tank cannons, are typically breech loaded from inside the tank and electrically activated and fired also from within the tank. The projectiles typically are connected by a conductor to a firing pin which connects a source of direct current (DC) voltage supplied to the base of the round cartridge at the primer button with a thermal battery located in the nose portion of the projectile which, in turn, generates the power to operate the projectile electronics. The projectile electronics utilize memory storage to operate the pre-programmed target acquisition or proximity system, and the arming and detonating devices in the shell during the flight of the shell. A primer circuit which ignites the primer which, in turn, ignites the main propellant charge to fire the round is energized sequentially by DC voltage of opposite polarity after the thermal battery is activated.

This is further illustrated in FIGS. 3A and 3B, and will be described in greater detail with reference to the round of FIG. 1 below. The entire system, then, has conventionally been activated utilizing a programmed direct current (DC) source such as that shown in FIG. 3A. In FIG. 3A, a source of direct current, which normally is the storage battery of the tank, is depicted at 11 as being connected to a fire control box 12 as, for example, by a polarity reversing double pole switch 13. The projectile contains a control electronics package 22, powered by a thermal battery **14*a* activated by an electric match depicted at 14 which is located in the forward portion or nose of the projectile. A primer 15 is attached to the fire circuit which includes bridge wire 16. The battery match 14 and the primer bridge wire 16 are connected in parallel to the source of DC voltage which is applied through the primer button 17 via conductors 18 and 19, respectively. Oppositely disposed diodes 20 and 21 operate in conjunction with the fire control box 12 and switch 13 to control the activation and firing sequence of the round. As shown in the waveform of FIG. 3B, the initial signal transmitted into the electrical system is a voltage having a negative polarity which, in turn, is blocked by the diode 21 and transmitted by the diode 20 thereby activating the thermal match 14 and the associated thermal battery system 14*a* which, in turn, activates the projectile electronics package 22. After a short duration, perhaps 5 msec, the voltage is returned to polarity zero for another short period of time, possibly 5 msec, and thereafter the voltage is reversed to a positive value which, in turn, is transmitted by diode 21 and blocked by diode 20 such that positive voltage is now pressed across the primer bridge wires 16 which are heated by resistance and burn through almost at once, thereby igniting a primer material which, in turn, ignites the main propellant charge, firing the projectile. In the interim, the thermal battery which was first activated has activated all the projectile electronics including any target acquisition or proximity sensing devices, together with the electronics associated with arming and detonating the shell. Of course, the conductor 18 is destroyed during the firing of the projectile, but it is of no further use once the thermal battery 14*a* is activated. The voltage waveform shown in FIG. 3B is generated by electronics in the fire control box 12 and switch 13** in a well-known manner and is utilized herein to described the presently known direct current method of arming and firing such projectiles.

With the typical DC system, it is much more difficult and, in some cases, not possible to change or update any preprogrammed information stored in the electronics package in the nose of the projectile. It would present a definite and desirable advance in the art if it were possible to communicate additional information to the projectile to update the memory just prior to launch. It would be convenient if this could be accomplished utilizing a data transmission system with high frequency carrier AC capabilities. This would allow the transmission of high frequency data to the sensor electronics, which would enable the tank crew to take full advantage of updated information with respect to the immediate situation and thereby enable them to more fully utilize the sophisticated capabilities of the projectile itself on a real-time basis.

SUMMARY OF THE INVENTION

In accordance with the present invention, there is provided an improved data transmission system for ammunition which includes a high frequency system which can be used to transmit data to the sensor electronics just prior to firing the shell. The system enables the passage of updated or real-time sensor-oriented information to the projectile control system just prior to the ignition of the ammunition propellant. The system includes a high energy DC primer system having a high frequency blocking device which operates in conjunction with a transmission line for transferring low energy, high frequency data to the sensor electronics which contains a device which blocks the high energy DC primer ignition voltages. In this manner, high frequency AC voltage, which can be generated from the DC source as by a modulated high frequency oscillator system, can be utilized to transmit information to the "smart" projectile without affecting the firing circuit and, conversely, the conventional high energy DC voltage can be utilized thereafter to fire the shell in the conventional manner without affecting the delicate projectile electronics.

In the preferred embodiment, the entire system can be energized using a conventional lead-acid DC storage battery such as that found in a tank. The data transmission portion of the system includes a modulated high frequency oscillator to convert DC and program data to high frequency modulated AC, which operates over the transmission line to transfer low energy, high frequency data to the sensor electronics, normally in the nose of the projectile. The primer circuit contains an inductor coil, or the like, to block the high frequency AC and prevent premature ignition of the primer. The primer circuit includes a primer housing containing an ignition electrode also connected in parallel with the transmission line which readily passes DC to ignite the primer bridge wires or otherwise kindle the primer to initiate firing of the round. The data transmission system also contains a capacitor, or the like, to block the subsequent DC applied to the primer circuit to prevent interference with the projectile electronics thereafter.

BRIEF DESCRIPTION OF THE DRAWINGS

In the drawings, wherein like numerals are utilized to designate like parts throughout the same.

DESCRIPTION OF THE ILLUSTRATIVE EMBODIMENT

Figure 1:
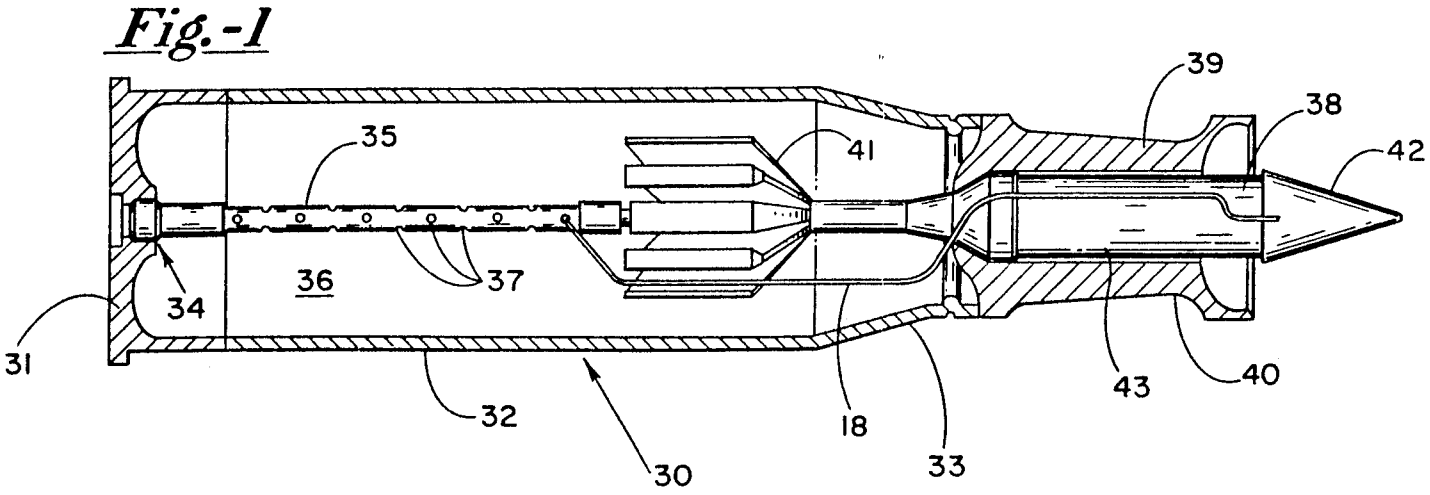
FIG. 1 is a view, partially in section, of a typical large caliber round of a class incorporating the data transmission system of the invention.
Figure 2B:
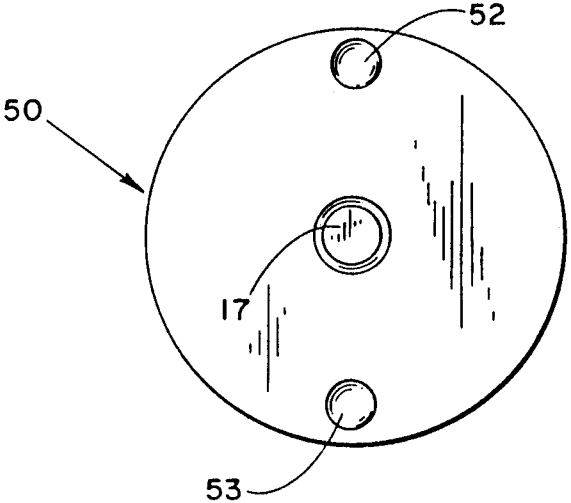
FIG. 2B is an end view along lines 2B—2B of FIG. 2A.

FIG. 1 depicts a typical large caliber round which may be fired by the main turret cannon of a tank or other such large caliber device. The round is shown generally at 30 and includes a base plate section 31 connected with the wall of a cartridge casing having a generally cylindrical central portion 32 and a necked-down or tapered upper portion 33. A primer housing, shown generally at 34, is discussed in greater detail in accordance with FIGS. 2A and 2B, below. The primer housing is connected with a generally hollow brass or other type metal primer tube 35 having a plurality of openings accessing the general propellant charge volume 36 at 37. The shell cartridge depicted by 32 and 33 may be metallic but is preferably made of molded nitrocellulose or other combustible material which is consumed during the firing of the shell. The projectile itself is shown at 38 with discarding sabot members 39 and 40 which drop off when the projectile 38 leaves the barrel of the cannon. A plurality of stabilizing guidance fins 41 are also provided. The electronics package is located in the nose cone section 42 of the projectile 38, and the arming and detonating circuitry are usually located in the warhead section 43. The communication conductor or transmission line connecting the projectile electronics with the electrical input is shown at 18.

Figure 2A:
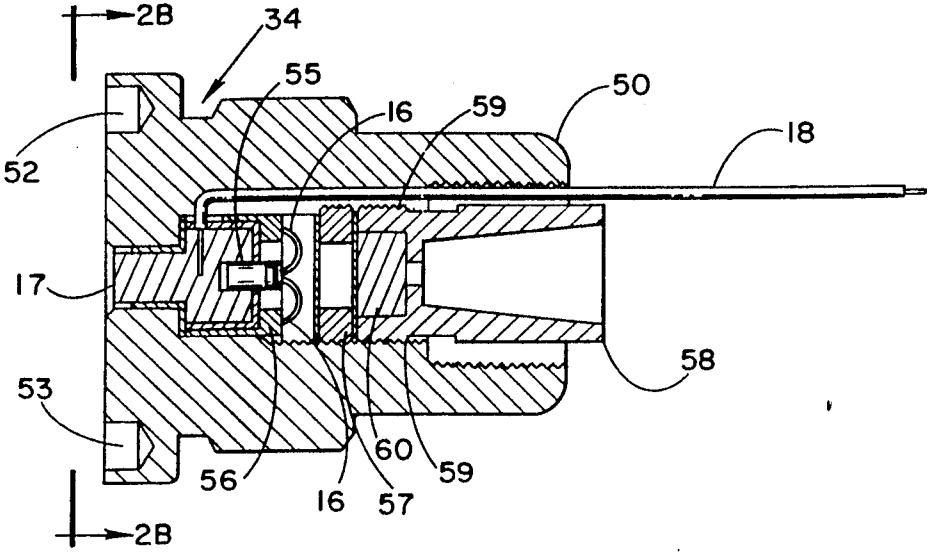
FIG. 2A is a greatly enlarged, fragmentary sectional view of the primer housing of the shell of FIG. 1.
Figure 3A:
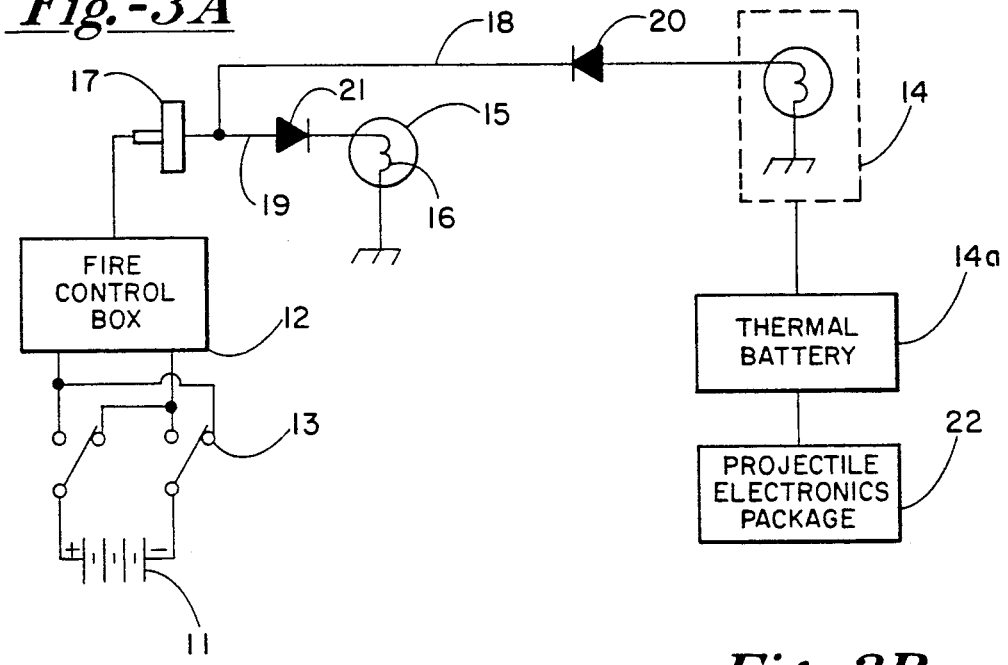
FIG. 3A is a circuit depicting a prior art DC electrical shell activating and firing system.
Figure 3B:
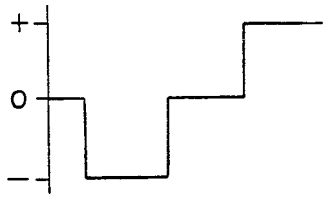
FIG. 3B depicts a voltage waveform utilized in conjunction with the circuit of FIG. 3A.

The primer head loading assembly for the round is depicted in the drawing of FIG. 2A and includes a generally cylindrical plug member or primer housing 50, which is fastened to a conductive base plate member 31 (FIG. 1) as by spanner holes at 52 and 53. The primer housing 50 also contains conductive ignition electrode or primer button 17 which partially captivates an induction coil at 55 which, in turn, is connected to bridge wire 16. Retainer elements 56 and 57, and primer tube retainer 58, which partially supports the primer tube 35 (FIG. 1), is threadably attached as at 59. Additional priming material is shown at 60.

Figure 4:
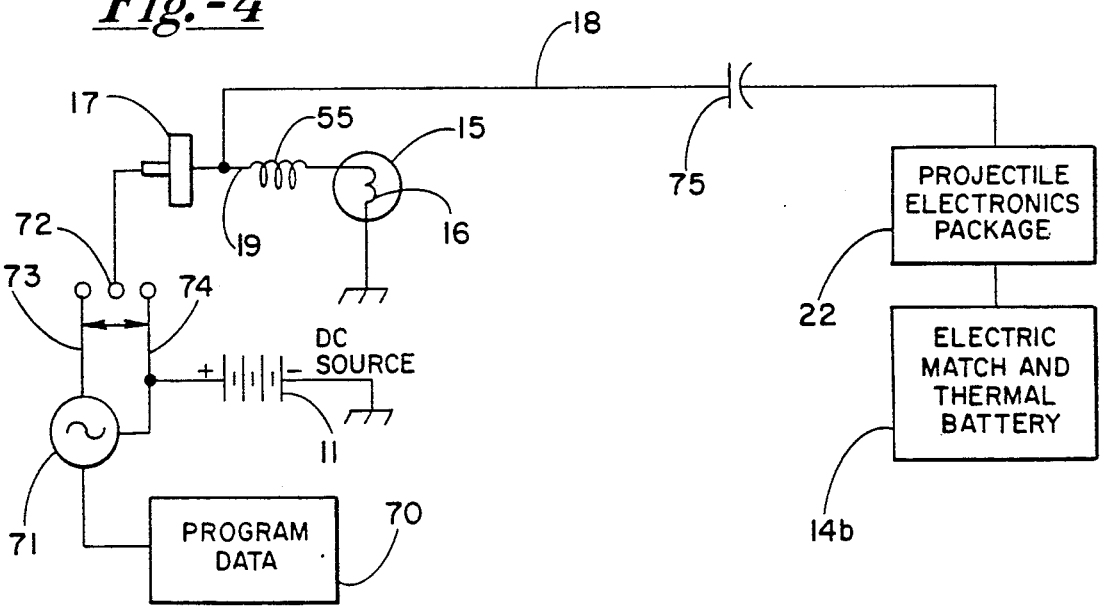
FIG. 4 is an electrical schematic diagram showing the data transmission and firing system in accordance with the invention.

FIG. 4 depicts the data transmission and shell firing system of the invention. It includes a source of DC such as the main storage battery 11 of a tank which is connected to a high frequency oscillator 71. Program data 70 is additionally supplied to the high frequency oscillator 71 to modulate its output to switch contact 73. This system is connected in parallel with DC from the battery 11 and can be alternately applied to the primer button 17 through switch elements 72, 73 and 74. The transmission line 18 connects the primer button with the electronics package 22 which, in turn, activates the thermal battery or other DC current supply and accepts data at **14*b*. The primer circuit further depicts the inductor 55 between the primer button and the primer bridge wires 16**.

In operation, the switch pole element 72 is initially positioned to transmit high frequency data to the electronics package using AC on switch contact 73 which activates the thermal battery or other power source and carries information to update the electronics in the projectile. The high frequency AC is blocked on line 19 by inductor 55. The switch pole element 72 is then moved to connect DC switch contact 74 with the primer button which connects high power DC with the primer wires 16, thereby firing the primer and through the primer tube 35 (FIG. 1) and igniting the main propellant charge in 36 (FIG. 1). The capacitor 75 blocks the DC from interfering with the electronics in the system.

This invention has been described in this application in 10 considerable detail in order to comply with the Patent Statutes and to provide those skilled in the art with the information needed to apply the novel principles and to construct and use such specialized components as are required. However, it is to be further understood that the invention can be carried out by specifically different equipment and devices and that various modifications both as to equipment and procedure details can be accomplished without departing from the scope of the invention itself.

I claim:

1. A data transmission system for an ammunition round including a propellant charge, the system comprising:

a source of direct current (DC) voltage;

a source of alternating current (AC) voltage;

an electronic control package for the round;

an electric primer system for igniting the propellant charge to fire the round; and means for alternately providing electrical communication between the AC voltage source and the electronic control package and between the source of DC voltage and the electric primer system.

2. An improved data transmission system for an ammunition round including a propellant charge, the system comprising:

a source of high frequency alternating current (AC) voltage;

a source of direct current (DC) voltage;

an AC voltage activated electronic control package for the round;

a DC voltage activated electric primer system for igniting the propellant charge to fire the round;

wherein both the electronics control package and the electric primer system are connected in parallel with the source of AC voltage and the source of DC voltage; and wherein the parallel connected circuitry contains a first circuit means to prevent DC voltage from reaching the electronics control package and a second circuit means for preventing AC voltage from reaching the electric primer system.

3. The apparatus of claim 2 wherein the first circuit means comprises a capacitor.

4. The apparatus of claim 2 wherein the second circuit means comprises in inductor.

5. The apparatus of claim 2 wherein the first circuit means comprises a capacitor and the second circuitry means comprises an inductor.

* * * * *